US011796218B2

(12) United States Patent
Zhang et al.

(10) Patent No.: US 11,796,218 B2
(45) Date of Patent: Oct. 24, 2023

(54) FAN HOUSING AND AIR CONDITIONER DEVICE

(71) Applicant: Carrier Corporation, Palm Beach Gardens, FL (US)

(72) Inventors: Hongbao Zhang, Shanghai (CN); Junjie Ji, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 279 days.

(21) Appl. No.: 16/639,984

(22) PCT Filed: Aug. 14, 2018

(86) PCT No.: PCT/US2018/046686

§ 371 (c)(1),
(2) Date: Feb. 18, 2020

(87) PCT Pub. No.: WO2019/036457

PCT Pub. Date: Feb. 21, 2019

(65) Prior Publication Data

US 2020/0200431 A1 Jun. 25, 2020

(30) Foreign Application Priority Data

Aug. 18, 2017 (CN) ..... 201721037654.7

(51) Int. Cl.
*F24F 13/08* (2006.01)
*F04D 29/70* (2006.01)

(52) U.S. Cl.
CPC ..... *F24F 13/084* (2013.01); *F04D 29/703* (2013.01)

(58) Field of Classification Search
CPC ..... F24F 13/08; F24F 13/082; F24F 13/084; F24F 13/20; F04D 29/544; F04D 29/703
(Continued)

(56) References Cited

U.S. PATENT DOCUMENTS 515,405 A 2/1894 Meston
967,971 A 8/1910 Pollak
(Continued)

FOREIGN PATENT DOCUMENTS

CN 201259295 Y 6/2009
CN 301357616 9/2010
(Continued)

OTHER PUBLICATIONS

OSHA STD 01-12-001, Defining Acceptable Guarding of Fan Blades, Oct. 1978 (Year: 1978).*
(Continued)

*Primary Examiner* — Woody A Lee, Jr.
*Assistant Examiner* — Justin A Pruitt
(74) *Attorney, Agent, or Firm* — CANTOR COLBURN LLP

(57) ABSTRACT

The present utility model provides a fan cover shell and an air conditioning unit having the same. The fan cover shell includes an outer frame; multiple annular auxiliary reinforcement ribs, arranged from the center of the fan cover shell towards the outer frame; and multiple main reinforcement ribs, respectively extending from the center of the fan cover shell to the outer frame and intersecting with the auxiliary reinforcement ribs to form multiple ventilation grills; the main reinforcement rib forms a multi-section curve, and any adjacent curves of the multi-section curve bend towards a reverse direction. According to the fan cover shell of the present utility model, a better air guide effect is achieved by optimizing the main reinforcement ribs.

12 Claims, 3 Drawing Sheets

(58) Field of Classification Search
USPC ..... 415/121.2; 416/247 R
See application file for complete search history.

(56) References Cited

U.S. PATENT DOCUMENTS

| | | | | |
|---|---|---|---|---|
| 1,383,616 | A | 7/1921 | Gilbert | |
| 1,448,896 | A | 3/1923 | Young | |
| 1,604,178 | A | 10/1926 | Lawrence | |
| 1,764,788 | A | 6/1930 | Hatch | |
| 1,769,922 | A * | 7/1930 | Harris | F24F 7/013 454/209 |
| 2,017,431 | A * | 10/1935 | Anderson | F04D 29/703 416/247 R |
| 4,927,324 | A * | 5/1990 | Coup | F04D 25/08 415/121.2 |
| 5,112,175 | A * | 5/1992 | Wilkening | F16B 37/14 411/372.5 |
| 5,259,726 | A * | 11/1993 | Bacria | F04D 29/703 415/119 |
| 5,838,534 | A * | 11/1998 | Yang | H05K 5/0013 361/600 |
| D414,256 | S * | 9/1999 | Thomas, Jr. | D23/370 |
| 6,071,079 | A * | 6/2000 | Litvin | F04D 29/703 415/121.2 |
| D427,674 | S | 7/2000 | Moreno | |
| D451,594 | S | 12/2001 | Chen et al. | |
| D451,595 | S | 12/2001 | Chen et al. | |
| 6,341,806 | B1 * | 1/2002 | Chung | E05C 19/06 292/120 |
| 6,364,618 | B1 | 4/2002 | Moreno | |
| 6,503,060 | B1 | 1/2003 | Kamada et al. | |
| 6,764,277 | B2 | 7/2004 | Somahara et al. | |
| 7,021,895 | B2 | 4/2006 | Rubenstein et al. | |
| D645,953 | S | 9/2011 | Peterson et al. | |
| 8,182,218 | B2 | 5/2012 | Pearce et al. | |
| 9,116,420 | B2 | 8/2015 | Yamano et al. | |
| 9,366,266 | B2 | 6/2016 | Thrush et al. | |
| 10,487,736 | B2 * | 11/2019 | Servant | B64C 11/14 |
| 10,502,133 | B2 * | 12/2019 | Awasthi | F02C 7/04 |
| 10,578,322 | B2 * | 3/2020 | Sato | F24F 13/20 |
| 2005/0076668 | A1 | 4/2005 | Choi | |
| 2012/0115410 | A1 * | 5/2012 | Oliver | F24F 13/084 454/330 |
| 2014/0248145 | A1 | 9/2014 | Ediger et al. | |
| 2016/0108929 | A1 | 4/2016 | Su | |
| 2016/0305454 | A1 | 10/2016 | Gao et al. | |
| 2017/0306985 | A1 * | 10/2017 | Strehle | F04D 29/541 |
| 2017/0343016 | A1 * | 11/2017 | Kim | F04D 19/002 |

FOREIGN PATENT DOCUMENTS

| | | | |
|---|---|---|---|
| CN | 303267659 | | 7/2015 |
| DE | 20304033 | U1 | 7/2004 |
| DE | 102008042712 | A1 | 4/2010 |
| DE | 102014116047 | A1 | 5/2016 |
| EP | 2123917 | A2 | 11/2009 |
| EP | 2444756 | A1 | 4/2012 |
| FR | 722693 | A | 3/1932 |
| GB | 368858 | A | 3/1932 |
| JP | 2007100979 | A | 4/2007 |
| KR | 20160072719 | A | 6/2016 |
| KR | 20170086313 | A | 7/2017 |
| WO | 14119813 | A1 | 8/2014 |
| WO | 20170041967 | A1 | 3/2017 |

OTHER PUBLICATIONS

International Search Report and Written Opinion for application PCT/US2018/046686, dated Nov. 23, 2018, 13 pages.

* cited by examiner

FAN HOUSING AND AIR CONDITIONER DEVICE

TECHNICAL FIELD

The present utility model relates to the field of refrigeration, and specifically, relates to a fan cover shell of an air conditioning unit.

BACKGROUND ART

A conventional air conditioning unit usually includes an indoor unit for evaporation and heat absorption and an outdoor unit for condensation and heat dissipation. For the outdoor unit, in order to enhance air convection, improve the heat dissipation effect, and reduce pressure drop and noise, various optimization designs have been conducted for its structural form. One type of the outdoor unit adopts a grill with side air outlets. At this time, a fan cover shell is arranged on the side of the outdoor unit of the air conditioning unit, so as to be aligned with a fan and heat dissipation fins of a condenser disposed inside the outdoor unit to improve the flow area between air and the heat dissipation fins and thus the heat transfer effect. Another development direction is to modify the specific form of the grill on the fan cover shell. For example, grills formed by arranging annular reinforcement ribs and radial reinforcement ribs in a staggered manner are used; for another example, grills formed by arranging horizontal reinforcement ribs and vertical reinforcement ribs in a staggered manner are used. Under the background that the heat dissipation structure of the outdoor unit becomes increasingly mature, how to further improve its heat dissipation effect and reduce pressure drop and noise has become a new research direction.

SUMMARY OF THE INVENTION

The present utility model aims to provide a fan cover shell, so as to improve an air guide effect.

The present utility model also aims to provide an air conditioning unit, so as to improve an air guide effect.

According to an aspect of the present utility model, a fan cover shell is provided, which includes: an outer frame; multiple annular auxiliary reinforcement ribs, arranged from the center of the fan cover shell towards the outer frame; and multiple main reinforcement ribs respectively extending from the center of the fan cover shell to the outer frame and intersecting with the auxiliary reinforcement ribs to form multiple ventilation grills, where the main reinforcement rib forms a multi-section curve, and any adjacent curves of the multi-section curve bend toward a reverse direction.

According to another aspect of the present utility model, an air conditioning unit is further provided, which includes the fan cover shell as stated above.

DETAILED DESCRIPTION

Figure 1:
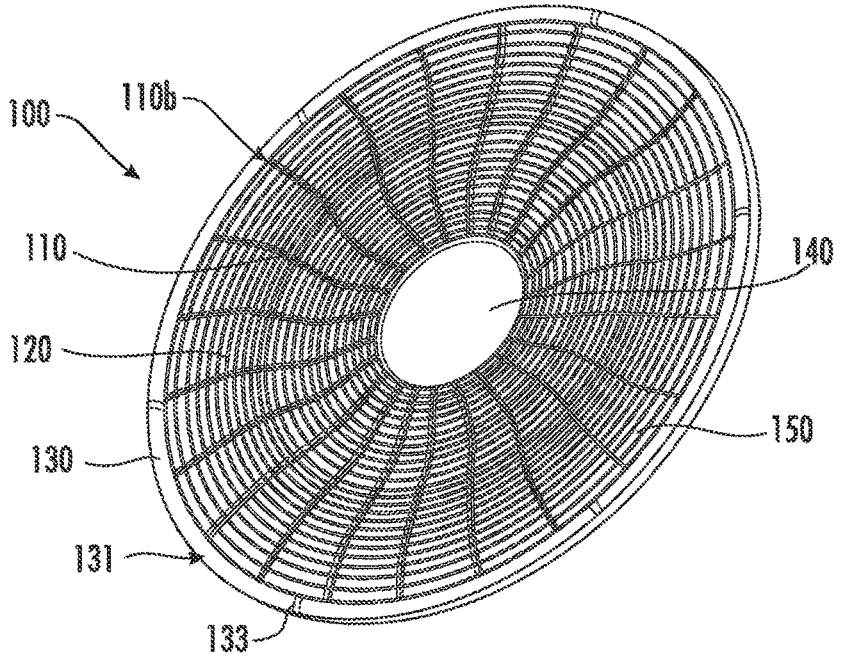
FIG. 1 is a schematic diagram of a leeward side of a fan cover shell according to an embodiment of the present utility model.
Figure 2:
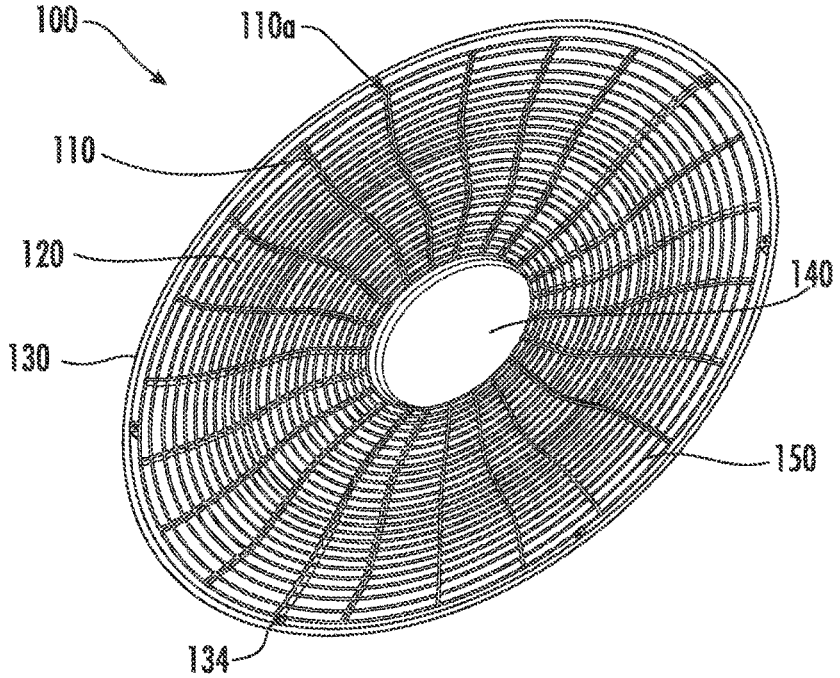
FIG. 2 is a schematic diagram of a windward side of the fan cover shell shown in FIG. 1.
Figure 3:
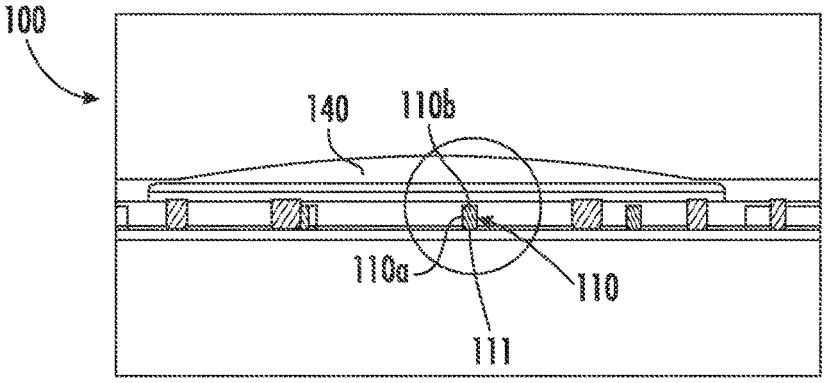
FIG. 3 is a partial sectional view of the fan cover shell shown in FIG. 1 in an axial direction.

Referring to FIGS. 1 and 2, an embodiment of a fan cover shell is shown. The fan cover shell 100 includes an annular outer frame 130 and a center plate 140 disposed at the center of the outer frame 130; multiple main reinforcement ribs 110 and multiple auxiliary reinforcement ribs 120 are arranged in a frame composed by the outer frame 130 and the center plate 140. Specifically, on one hand, the multiple auxiliary reinforcement ribs 120 each form a circular ring, and are arranged from the center plate 140 towards the outer frame 130, that is, the multiple auxiliary reinforcement ribs 120 are constructed into concentric circles; on the other hand, the multiple main reinforcement ribs 110 respectively extend from the center plate 140 to the outer frame 130 and intersect with the auxiliary reinforcement ribs to form multiple ventilation grills 150. The main reinforcement rib 110 forms a multi-section curve, and any two adjacent sections of curves of the multi-section curve bend towards a reverse direction (clockwise or anti-clockwise). Specifically, using a certain main reinforcement rib 110 in FIG. 1 as an example, and viewing from the center plate 140 towards the outer frame 130, the main reinforcement rib 110 first bends and protrudes towards a clockwise direction, subsequently bends and protrudes towards an anti-clockwise direction, and then bends and protrudes towards the clockwise direction again; moreover, the curvature of the whole curve changes smoothly and no saltation occurs; therefore, the curve is relatively gentle. The ventilation grill in this form will generate smaller windage, and air flowing through the ventilation grill can be blown to heat dissipation fins more smoothly, thus improving air guide and heat transfer performance.

The present application provides multiple detailed implementation manners for a fan cover shell including various parts, so as to further improve its performance, and description is given below by examples.

Figure 4:
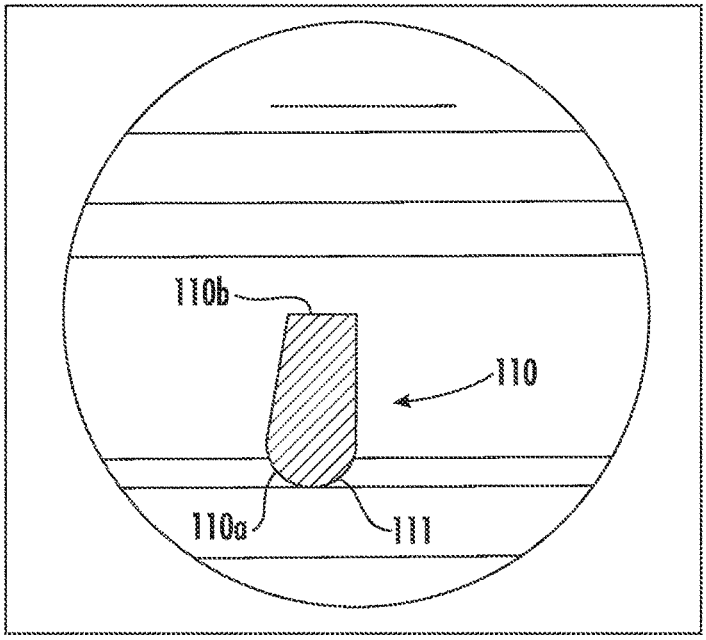
FIG. 4 is a partial enlarged view of a profile of the main reinforcement rib in FIG. 3.
Figure 5:
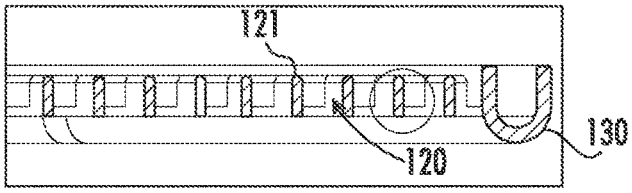
FIG. 5 is a partial sectional view of the fan cover shell shown in FIG. 1 in a radial direction.
Figure 6:
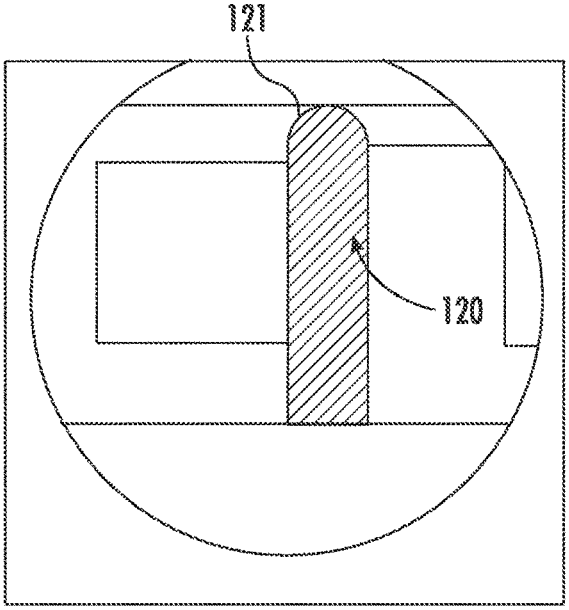
FIG. 6 is a partial enlarged view of the auxiliary reinforcement rib in FIG. 5.

Referring to FIGS. 1 and 4, for the main reinforcement rib 110, more details may be further improved. For example, to reduce the windage of air flowing through the grill, a first arc-shaped air guide surface 111 may be disposed at the windward side of the main reinforcement rib 110, so that frontal contact of air and the main reinforcement rib 110 becomes smoother, thereby avoiding frontal impact between air and the main reinforcement rib. On such basis, a width of the windward side of the main reinforcement rib 110 can also be set to be greater than that of the leeward side, thus a progressively-expanded flow channel is formed at the ventilation grills, which promotes turbulence of the air, improves a subsequent heat exchange process with the fins, and makes air guide at air outlets more condensed to prevent the phenomenon of wind inverse suction. In addition, the curvature and the arc length of a multi-section curve of the main reinforcement rib 110 gradually increases from the center of the fan cover shell 100 to an outer frame 130, and/or the main reinforcement ribs 110 have a width of 2-3 mm. It is found through multiple experiments that these structures or parameter designs are also helpful for improving the air guide performance.

In addition, regarding a relationship among the multiple main reinforcement ribs 110, an angle formed between adjacent main reinforcement ribs 110 is at least 15°, so as to avoid too small gaps between ventilation grills caused by too small distances between the main reinforcement ribs, and further avoid too large windage.

On the other hand, referring to FIGS. 1, 2, 5, and 6, for the auxiliary reinforcement ribs 120, multiple detail improvements can also be made. For example, to reduce the windage of air flowing through the grill, a second arc-shaped air guide surface 121 can be disposed at the windward side of the auxiliary reinforcement rib 120, so that frontal contact of air and the auxiliary reinforcement rib 120 becomes smoother, thereby avoiding frontal impact between air and the auxiliary reinforcement rib. On such basis, although it is not shown in the drawing, a width of the windward side of the auxiliary reinforcement rib 120 may also be set to be greater than that of the leeward side, so that a progressively-expanded flow channel is formed at the ventilation grills, which promotes turbulence of the air, improves a subsequent heat exchange process with the fins, and makes air guide at air outlets more condensed to prevent the phenomenon of wind inverse suction.

In addition, regarding a relationship among multiple auxiliary reinforcement ribs 120, a distance between adjacent auxiliary reinforcement ribs 120 is 8 mm-10 mm, so as to avoid too small gaps between the ventilation grills caused by too small distances between the auxiliary reinforcement ribs, and further avoid too large windage, which also avoids excessive gaps and avoids safety hazards.

Figure 7:
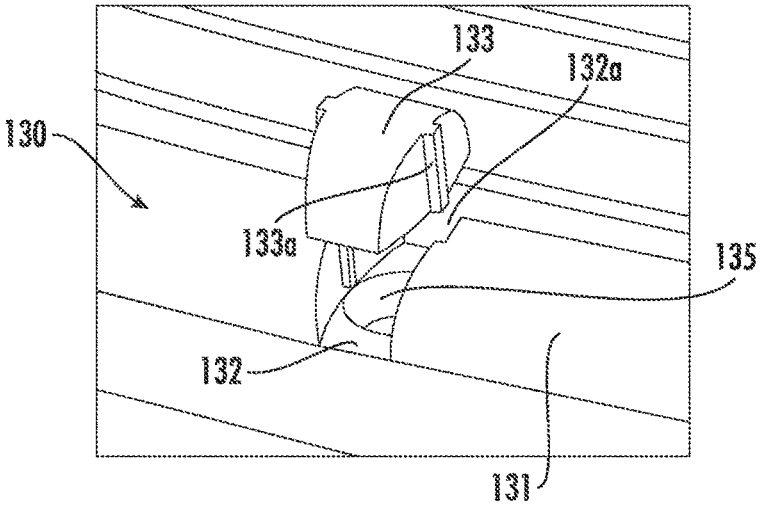
FIG. 7 is a schematic diagram of a hidden bolt mounting hole of the fan cover shell shown in FIG. 1.

On the other hand, referring to FIGS. 1, 2, and 7, to improve guide of air flowing through the fan cover shell, other improvements are also made in the present application to provide a smoother air guide surface for the fan cover shell. For example, a third arc-shaped air guide surface 131 can be disposed at the leeward side of the outer frame 130, so as to guide air flowing close to the frame.

At the same time, considering the actual application, it is also necessary to design fixing components between the fan cover shell and a surrounding air conditioning unit, such as bolts. After bolt fixing is completed, in order to avoid extra windage caused by a protruded nut, the present application also includes multiple grooves 132 disposed at the leeward side of the outer frame 130 and bumps 133 matching the grooves 132, and bolt mounting holes 134 disposed in the grooves 132; a surface of the bump 133 facing the leeward side has an outline matching the third arc-shaped air guide surface 131, and a surface of the bump 133 facing the groove 132 and the groove 132 together form bolt accommodation space 135. By means of such arrangement, during pre-mounting, the bumps 133 may be disassembled, so as to screw the bolt into the bolt mounting hole 134 in the groove 132 and then screw it into the fixing point on the cover shell of the air conditioning unit, thereby achieving positioning and fastening of them. After mounting is completed, the protruding part of the bolt may be accommodated in the bolt accommodation space 135, and subsequently the bump 133 is mounted back into the groove 132, so as to re-form a smooth and complete third arc-shaped air guide surface 131.

As a specific fixing method, side walls of the bumps 133 and the grooves 132 are respectively disposed with positioning ribs 133*a* and/or positioning grooves 132*a* that match with each other, thereby achieving simple assembly and disassembly of them.

In addition, considering fixing firmness of the fan cover shell and a cover shell of the air conditioning unit, 6-8 bolt mounting points are often disposed, that is, matching 6 to 8 groups of grooves and bumps matching the grooves.

Other Changes

Definitions of "windward side" and "leeward side" herein are in terms of air flow directions. One side facing an air flowing direction is the "windward side", and one side away from the air flowing direction is the "leeward side". For example, referring to FIG. 1, when the fan cover shell 100 is installed in an air conditioning unit, the surface shown in FIG. 1 should be mounted at the outer side of the air conditioning unit, and the surface not shown should be mounted at the inner side of the air conditioning unit. After mounting is completed, under drive of a fan in the air conditioning unit, air sequentially flows through radiator fins in the air conditioning unit, the fan, the inner side of the fan cover shell, and the outer side of the fan cover shell, and then flows out. At this time, the inner side of the fan cover shell is "the windward side", and the outer side of the fan cover shell (that is, the side of the fan cover shell shown in FIG. 1) is "the leeward side".

Based on the above disclosed content, an air conditioning unit is additionally provided, which includes the fan cover shell in any above embodiment or any combination of the embodiments. Therefore, the air conditioning unit also has corresponding improved air guide and heat transfer effects.

The above examples mainly describe a fan cover shell of the present utility model and an air conditioning unit having the same. Although only some implementation manners of the present invention are described, a person of ordinary skill in the art should know that the present invention may be implemented in many other forms without departing from the subject matter and scope of the present invention. Therefore, the displayed examples and implementation manners are intended to be illustrative and not restrictive, and the invention may be modified and substituted without departing from the spirit and scope of the present invention as defined by the appended claims.

The invention claimed is:

1. A fan cover shell, comprising:

an outer frame;

multiple annular auxiliary reinforcement ribs, arranged from a center of the fan cover shell towards the outer frame; and multiple main reinforcement ribs respectively extending from the center of the fan cover shell to the outer frame and intersecting with the auxiliary reinforcement ribs to form multiple ventilation grills, wherein at least one of the main reinforcement ribs forms a multi-section curve, wherein from the center of the fan cover to the outer frame, the at least one of the main reinforcement rib bends towards a clockwise direction and subsequently bends towards an anti-clockwise direction, and then bends towards the clockwise direction again; and a first arc-shaped air guide surface is disposed on a windward side of the main reinforcement rib, and a width of the windward side of the main reinforcement rib is greater than that of a leeward side.

2. The fan cover shell according to claim 1, wherein a curvature and arc length of the multi-section curve gradually increase from the center of the fan cover shell towards the outer frame.

3. The fan cover shell according to claim 1, wherein an angle formed between adjacent main reinforcement ribs is at least 15°.

4. The fan cover shell according to claim 1, wherein a gap between adjacent auxiliary reinforcement ribs is 8 mm-10 mm.

5. The fan cover shell according to claim 1, wherein a second arc-shaped air guide surface is disposed at a windward side of at least one of the auxiliary reinforcement ribs, and a width of the windward side of the at least one of the auxiliary reinforcement ribs is greater than that of the leeward side.

6. The fan cover shell according to claim 1, wherein a third arc-shaped air guide surface is disposed at the leeward side of the outer frame.

7. The fan cover shell according to claim 6, further comprising multiple grooves disposed at the leeward side of the outer frame and bumps matching the grooves, bolt mounting holes being disposed in the grooves, wherein a first surface of at least one of the bumps facing the leeward side has an outline matching the third arc-shaped air guide surface, and a second surface of the at least one of the bumps facing the at least one of the grooves and the at least one of the grooves forming a bolt accommodation space.

8. The fan cover shell according to claim 7, wherein side walls of the at least one of the bumps and side walls of at least one of the grooves are respectively disposed with positioning ribs and/or positioning grooves that engage each other.

9. The fan cover shell according to claim 7, comprising 4-8 of the grooves and bumps.

10. The fan cover shell according to claim 1, further comprising a center plate disposed at the center of the outer frame, the multiple main reinforcement ribs respectively extending from the center plate to the outer frame.

11. An air conditioning unit, comprising the fan cover shell according to claim 1.

12. The fan cover shell according to claim 1, wherein a plurality of the multiple main reinforcement ribs include the multi-section curve, wherein from the center of the fan cover to the outer frame, the plurality of the multiple main reinforcement ribs bend towards a clockwise direction and subsequently bend towards an anti-clockwise direction and then bend towards the clockwise direction again.

* * * * *